United States Patent [19]

Grego

[11] Patent Number: 4,540,130

[45] Date of Patent: Sep. 10, 1985

[54] DRUM FOR WINDING FILAMENTARY MATERIAL

[75] Inventor: Giorgio Grego, Turin, Italy

[73] Assignee: CSELT - Centro Studi e Laboratori Telecomunicazioni SpA, Turin, Italy

[21] Appl. No.: 609,188

[22] Filed: May 11, 1984

[30] Foreign Application Priority Data

May 11, 1983 [IT] Italy ..... 53304/83[U]

[51] Int. Cl.[3] ..... B65H 54/54; B65H 75/24

[52] U.S. Cl. ..... 242/18 G; 242/46.6; 242/72 B

[58] Field of Search ..... 242/18 G, 46.2, 46.4, 242/46.6, 72 B; 279/2 R, 2 A

[56] References Cited

U.S. PATENT DOCUMENTS

| | | | |
|---|---|---|---|
| 1,297,809 | 3/1919 | Dixon | 242/72 B |
| 2,312,012 | 2/1943 | Wallace | 242/72 B X |
| 3,139,242 | 6/1964 | Banlier | 242/72 B X |
| 3,166,335 | 1/1965 | Mason | 242/72 B X |
| 4,339,022 | 7/1982 | Hoover | 242/72 B X |

FOREIGN PATENT DOCUMENTS

| | | | |
|---|---|---|---|
| 127367 | 3/1932 | Fed. Rep. of Germany . | |
| 910271 | 4/1954 | Fed. Rep. of Germany | 242/72 B |
| 1137828 | 10/1962 | Fed. Rep. of Germany . | |
| 1189330 | 3/1959 | France . | |

*Primary Examiner*—Stanley N. Gilreath

*Attorney, Agent, or Firm*—Karl F. Ross; Herbert Dubno

[57] ABSTRACT

A drum for winding up filamentary material, such as optical fibers, has a generally cylindrical unitary flangeless hollow body of airtight and somewhat resilient polymeric material inflated under a fractional gauge pressure through a valve in one of its end walls. A bore in each end wall, centered on the cylinder axis, enables the drum to be coupled with a driving mechanism.

3 Claims, 2 Drawing Figures

DRUM FOR WINDING FILAMENTARY MATERIAL

FIELD OF THE INVENTION

My present invention relates to a drum for winding up filamentary material, specifically optical fibers, under low or moderate tension.

BACKGROUND OF THE INVENTION

Conventional drums or capstans used for such a windup are generally solid with only a slight degree of elasticity, e.g. when made from foam polystyrene. Their diameters are not adjustable so that fibers wound thereon always retain their initial tension. This is sometimes undesirable, as where tests on tensile strength are to be performed under a modified stress. In many instances it would also be useful to reduce that tension to zero so that a fiber package wound on the drum could be slid off axially for storage as a skein.

OBJECT OF THE INVENTION

The object of my present invention, therefore, is to provide an improved drum for winding up optical fibers—or possibly other filamentary material—having means for varying its effective diameter for purposes such as those referred to above.

SUMMARY OF THE INVENTION

I realize these objects, in accordance with my present invention, by providing a drum with a generally cylindrical unitary hollow body defined by an inflatable envelope of airtight polymeric material centered on an axis. The envelope, which of course should be reasonably resilient to facilitate its inflation, is under an internal pressure exceeding ambient pressure only by a fraction of an atmosphere (less than 1 full atmosphere or 1 bar above ambient); opposite end walls of that envelope have axial formations enabling it to be coupled to a driving mechanism for rotation of the body about its axis. The envelope is further provided with valve means enabling modification of its internal pressure.

Advantageously, the envelope has a peripheral wall which merges flangelessly along convex annular zones into the end walls whereby the peripheral wall can expand or contract, upon variation of the internal pressure, over its entire length so as substantially to preserve its cylindrical shape without bulging or sagging.

I further prefer to make the end walls of the envelope substantially thicker than its peripheral wall since these end walls, or at least one of them, must transmit the driving torque. The aforementioned valve means may be accommodated in one of these end walls, e.g. in an axial bore serving as a coupling formation for a drive or support shaft.

A suitable polymeric material for the drum envelope, which has the necessary resiliency while being hard enough to avoid wear or grooving by the fibers, is polytetrafluorethylene (Teflon) which could be charged with refractory particles, e.g. of alumina.

BRIEF DESCRIPTION OF THE DRAWING

The above and other features of my invention will now be described in detail with reference to the accompanying drawing in which.

SPECIFIC DESCRIPTION

Figure 1:
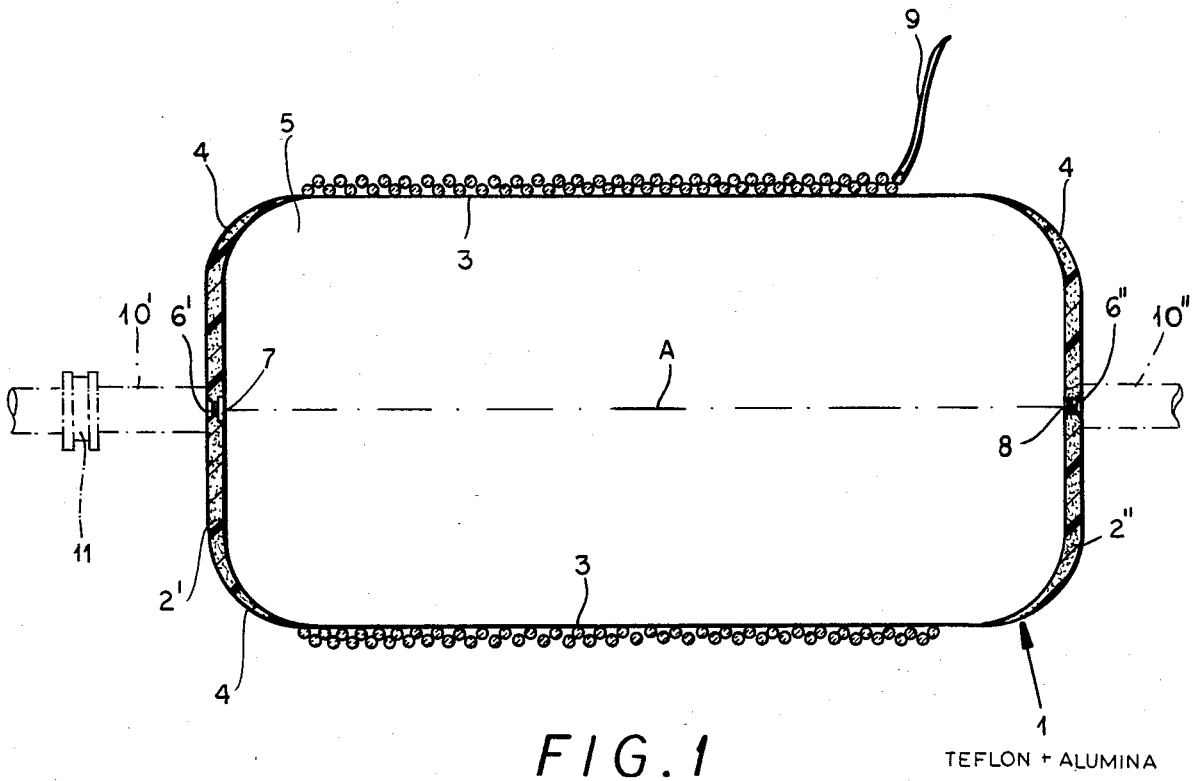
FIG. 1 is an axial sectional view of a winding drum embodying my invention.
Figure 2:
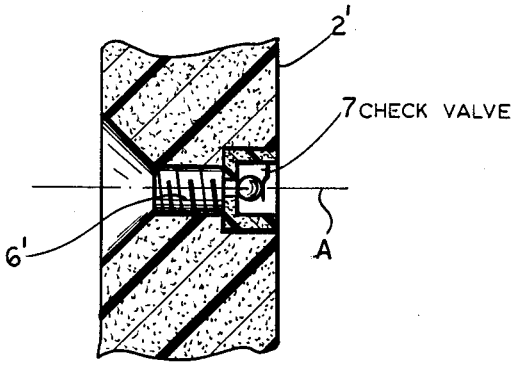
FIG. 2 is an enlarged sectional detail view of an end wall of the drum.

As shown in FIG. 1, a drum 1 according to my invention has an inflated unitary envelope of thermoplastic material, specifically Teflon loaded with alumina particles, forming two parallel end walls 2', 2'' perpendicular to an axis of rotation A on which a peripheral wall 3 of that envelope is centered. Peripheral wall 3 is faired into end walls 2', 2'' along convex annular zones 4 and is maintained inflated by air at a fraction of an atmosphere above ambient pressure, e.g. of 0.1 or 0.2 atmosphere gauge, in its interior 5. The two end walls 2' and 2'' are provided with respective bores 6', 6'' centered on axis A, the outer parts of these bores being threaded—as illustrated in bore 6' in FIG. 2—to facilitate the coupling of the drum to an external driving mechanism illustrated in phantom lines in FIG. 1. That mechanism is shown to comprise a drive shaft 10', carrying a pulley 11, and a support shaft 10'' with reduced extremities screwed into the threaded bores 6' and 6'', respectively. In order to prevent leakage from the drum even when the shafts are disconnected, the two bores are sealed against the interior 5 by a check valve 7 and a plug 8, respectively. Thus, bore 6'' is blind whereas bore 6' enables the inflation or deflation of the drum by introduction of a pump nozzle or of a pin repressing the ball check of valve 7. A filament 9, e.g. an optical fiber, is shown partly wound around the drum 1.

Nothing, of course, prevents the replacement of plug 8 by a second check valve serving as an alternate or a spare.

It will be noted that end walls 2' and 2'' are considerably thicker than peripheral wall 3. In a specific instance, with a drum having an axial length of one meter and a diameter of about half a meter, the peripheral wall may have a thickness on the order of one millimeter while the thickness of the end walls may be some ten millimeters.

If the partly wound fiber 9 is to be subjected to a stress test, e.g. under a tension of some 100 grams, this can be readily accomplished by the establishment of a suitable air pressure inside the drum. With the dimensions indicated above, a pressure increase of 0.1 atmosphere will produce a tensile stress of 500 grams.

Conversely, a partial deflation of the drum can rotate the winding stress to zero so that the turns wound on the drum can be slid off axially, in a vertical drum position, into an underlying container for storage as a skein.

I claim:

1. In an apparatus for winding up glass filaments and tensionally testing same, the improvement which comprises:

a generally cylindrical unitary drum constituted as an inflatable envelope of airtight polymeric material centered on an axis and having:

thin cylindrical peripheral walls coaxially surrounding said axis, a pair of relatively thick end walls lying in planes perpendicular to said axis and spaced apart along said axis with said peripheral wall located between them, and convex annular transition zones merging each of said end walls into said peripheral wall;

respective coaxial formations on said end walls;

respective shafts connected to said formations for rotatably supporting said drum and driving same in rotation about said axis; and valve means on one of said end walls for maintaining a selected internal pressure within said drum in excess of ambient pressure for entrainment of said filaments to draw them onto said drum.

2. The improvement defined in claim 1 wherein said formations are bores, said valve means being lodged in one of said bores and sealing same against the interior of said drum, the other of said bores being blind.

3. The improvement defined in claim 2 wherein the axial length of said drum substantially exceeds the diameter thereof and wherein said polymeric material is polytetrafluorethylene and is charged with alumina particles.

* * * * *